US005120351A

United States Patent [19]

Kitagawa

[11] Patent Number: 5,120,351

[45] Date of Patent: Jun. 9, 1992

[54] FERRITE MOLDING AND ITS MANUFACTURING METHOD

[75] Inventor: Hiroji Kitagawa, Nagoya, Japan

[73] Assignee: Kitagawa Industries Co., Ltd., Japan

[21] Appl. No.: 682,601

[22] Filed: Apr. 9, 1991

[30] Foreign Application Priority Data

Jun. 6, 1990 [JP] Japan ..... 2-148157

[51] Int. Cl.[5] ..... C22C 29/12

[52] U.S. Cl. ..... 75/232; 419/19; 419/32; 419/38; 419/39

[58] Field of Search ..... 419/19, 32, 38, 39; 75/232

[56] References Cited

U.S. PATENT DOCUMENTS

| | | | |
|---|---|---|---|
| 3,502,584 | 3/1970 | Denes | 252/62.55 |
| 3,775,328 | 11/1973 | Denes | 252/62.55 |
| 4,255,193 | 3/1981 | Slesar et al. | 75/232 |
| 4,966,625 | 10/1990 | Charles et al. | 75/232 |
| 5,000,909 | 3/1991 | Charles et al. | 75/232 |
| 5,001,014 | 3/1991 | Charles et al. | 75/232 |
| 5,002,727 | 3/1991 | Okimoto et al. | 419/10 |

FOREIGN PATENT DOCUMENTS

| | | |
|---|---|---|
| 59-151499 | 8/1984 | Japan . |
| 59-154710 | 9/1984 | Japan . |
| WO86/01196 | 2/1986 | PCT Int'l Appl. . |
| WO87/04425 | 7/1987 | PCT Int'l Appl. . |
| 2238306 | 9/1990 | United Kingdom . |

*Primary Examiner*—Stephen J. Lechert, Jr.
*Attorney, Agent, or Firm*—Davis, Bujold & Streck

[57] ABSTRACT

This invention is a ferrite molding made by a manufacturing method of molding and sintering ferrite particles, which are made by pre-sintering of magnetic materials including iron oxide, together with metallic particles mixed therein by a hydrostatic pressing at extra-high pressure, whereby metal fills in between the ferrite particles. The ferrite molding has improved ductility so as to resist chipping and breaking and has extremely low hydroscopicity so as to maintain its characteristics.

16 Claims, 1 Drawing Sheet

1 ··· FERRITE PARTICLE
2 ··· METAL

1 ··· FERRITE PARTICLE
2 ··· METAL

FERRITE MOLDING AND ITS MANUFACTURING METHOD

BACKGROUND OF THE INVENTION

This invention relates to a ferrite molding used as an electrical noise absorber for absorbing electrical noise when covering a conductor of an electronic apparatus and as a wave absorber for preventing side lobes when covering a parabolic antenna, and also relates to a manufacturing method for ferrite moldings.

A conventional ferrite molding is manufactured by sintering a mixture of magnetic materials including iron oxide, grinding the sintered mixture into ferrite particles, granulating the ferrite particles to have a predetermined particle size, and molding and sintering the granulated ferrite particles by a hydrostatic pressing.

However, being mechanically brittle and not having enough ductility, the conventional ferrite molding often cracks and/or chips in processing. Furthermore, the ferrite molding is highly hydroscopic and its properties are prone to deteriorate because gaps exist among ferrite particles.

SUMMARY OF THE INVENTION

Wherefore, it is an object of the present invention to provide a ferrite molding having improved ductility and no gaps among ferrite particles, and its manufacturing method.

Other objects and benefits of the invention will become apparent from the detailed description which follows hereinafter when taken in conjunction with the drawing figures which accompany it.

This object is achieved by the present invention, which provides:

a ferrite molding made by sintering a mixture of magnetic materials including iron oxide, in which metal is filled between ferrite particles; and a manufacturing method of the ferrite molding comprising the steps of:

sintering a mixture of magnetic materials including iron oxide;

grinding the mixture into ferrite particles;

granulating the ferrite particles to have a predetermined particle size; and molding and sintering the granulated ferrite particles by hydrostatic pressing, wherein the granulated ferrite particles are mixed with metallic particles prior to molding and sintering by hydrostatic pressing at extra-high pressure.

The ferrite molding of the present invention has hardly any residual pores due to the metal filling in any gaps among the ferrite particles, and has sufficient ductility due to the ductility of the metal.

In the manufacturing method of the ferrite molding as disclosed herein, metallic particles are mixed in the granulated ferrite particles and the ferrite particles and the metallic particles are molded under extra-high pressure. The metallic particles are crushed to smaller particles and fill in between the ferrite particles. The ferrite molding of the present invention is thus obtained.

The term "extra-high pressure" as used herein and in the appended claims generally means a pressure ranging between 3,000 kg/cm$^2$ and 10,000 kg/cm$^2$.

DETAILED DESCRIPTION OF A PREFERRED EMBODIMENT

Figure 1:
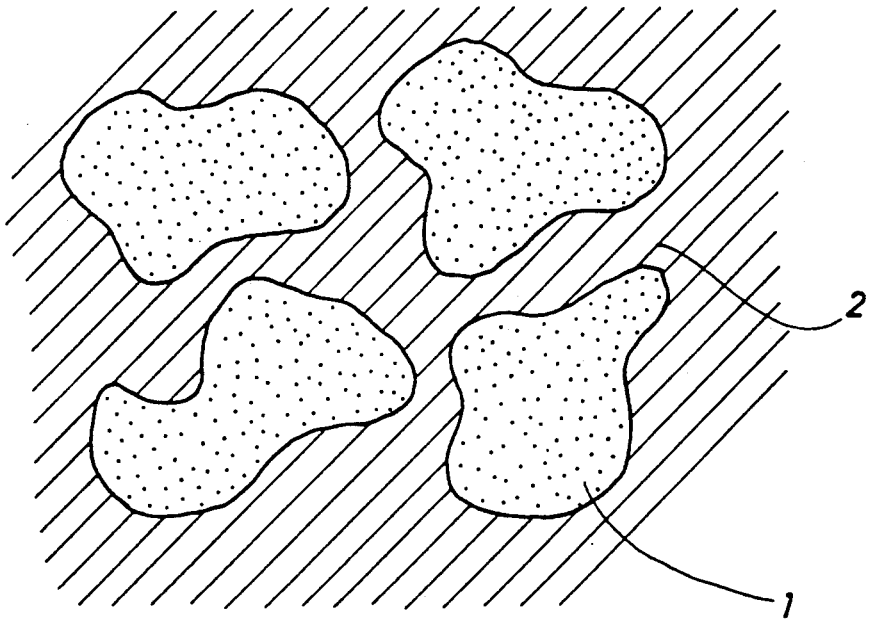
FIG. 1 illustrates a portion of a ferrite molding according to the present invention.

Hereinafter, an embodiment of the present invention is described with reference to the attached drawing and through the reporting of various test samples actually made and tested.

A number of ferrite moldings according to the present invention were manufactured according to the following procedure comprising steps a) through d).

a) Iron oxide ($Fe_2O_3$), nickel oxide (Nio) and zinc oxide (ZnO) were utilized as magnetic materials. 49.7 mol % of $Fe_2O_3$, 1.77 mol % of NiO, and 32.6 mol % of ZnO were weighed using a scale and thoroughly mixed in a ball mill. The mixture underwent pre-sintering at 900° C. in atmosphere and was crushed in a ball mill. From that, ferrite particles having an average diameter of 0.8 μm were obtained.

b) 1% by weight of polyvinyl alcohol (PVA) was added as a binder to the ferrite particles for granulation. After being granulated, the granulated ferrite particles were mixed with 1% by weight of metallic particles having a particle diameter of about 1 μm. According to the particle diameter and the kind of mixed metallic particles, the ferrite particles were classified into six kinds, namely, SAMPLE 1 through SAMPLE 6, as shown in Table 1.

TABLE 1

| | PARTICLE DIAMETER AFTER GRANULATION | METALLIC PARTICLES |
|---|---|---|
| SAMPLE 1 | 100 μm | Cu |
| SAMPLE 2 | 100 μm | Ir |
| SAMPLE 3 | 5 μm | Cu |
| SAMPLE 4 | 5 μm | Ir |
| SAMPLE 5 | RANDOM | Cu |
| SAMPLE 6 | RANDOM | Ir |

c) SAMPLES 1 through 6 were put in dies and molded under a pressure of 2,000 kg/cm$^2$ into blocks having dimensions of 30 by 30 by 12 mm. After having been sintered in an atmosphere of nitrogen containing oxygen at 1125° C. for 5 hours, the blocks were cooled in pure nitrogen.

d) The sintered and cooled blocks were put in high-density porcelain containers and gradually heated in inert gas at the rate of 100° C./hour. Subsequently, the blocks underwent hydrostatic pressing at ambient temperatures of 250° C. through 1300° C. at pressures of 3,000 kg/cm$^2$ through 10,000 kg/cm$^2$ for three hours.

Six kinds of ferrite moldings were thus manufactured from SAMPLES 1 through 6, respectively.

As a comparison, other ferrite moldings were manufactured in a conventional method; that is, SAMPLES 7, 8 and 9 were granulated to have particles diameters of 100 μm, 5 μm, and random diameters, respectively, and were sintered without mixing any metallic particles therewith.

Subsequent testing of the foregoing samples revealed that the ferrite moldings of the present invention made by sintering SAMPLES 1 through 6 have remarkably higher ductility than the ferrite moldings made by the conventional method. In addition, the present ferrite moldings do not easily crack or chip in processing.

As depicted in FIG. 2, metal 2 of copper (Cu) or iridium (Ir) has filled in any gaps among the ferrite particles 1 of the present invention ferrite molding. Having a chilled structure with no residual pores, the ferrite molding does not absorb moisture (i.e., it is not hydroscopic as with prior art ferrite moldings), thus allowing it to maintain stable properties.

When electromagnetic waves were radiated to an electric cable covered with the present ferrite moldings made of SAMPLES 1 through 6, electric current was hardly induced in the electric cable because the electromagnetic waves were absorbed by the ferrite particles of the ferrite moldings. Accordingly, the ferrite moldings, when utilized as an electrical noise absorber or the like, effectively attenuates electrical noise. In particular, ferrite particles having a particle diameter of 5 μm is an effective absorber for electromagnetic waves of short wavelength, i.e., about 2.5 GHz.

Wherefore, having thus described the present invention.

What is claimed is:

1. A method of manufacturing a ferrite molding having increased ductility and low hydroscopicity comprising the steps of:

a) sintering a mixture of magnetic materials including iron oxide;

b) crushing the sintered mixture into ferrite particles;

c) granulating the crushed ferrite particles;

d) mixing the granulated ferrite particles with metallic particles; and, e) molding and sintering the mixed granulated ferrite particles and metallic particles by hydrostatic pressing and heating to produce a ferrite molding comprising a mixture of ferrite particles having metal disposed in any gaps among the ferrite particles.

2. The method of claim 1, wherein:

said step of molding and sintering the mixed granulated ferrite particles and metallic particles by hydrostatic pressing and heating comprises pressing the mixed granulated ferrite particles and metallic particles at a pressure ranging between 3,000 kg/cm$^2$ and 10,000 kg/cm$^2$.

3. A method of manufacturing a ferrite molding having increased ductility and low hydroscopicity comprising the steps of:

a) thoroughly mixing and crushing magnetic material comprising iron oxide ($Fe_2O_3$), nickel oxide (Nio) and zinc oxide (ZnO) in a ball mill to obtain granulated ferrite particles having an average diameter of 0.8 μm;

b) mixing the granulated ferrite particles with 1% by weight of metallic particles having an average diameter of 1 μm to form a molding mixture;

c) placing the molding mixture in a die and molding it to a desired shape under a pressure of at least 2,000 kg/cm$^2$;

d) sintering the molded shape by heating in an atmosphere of nitrogen containing oxygen and then cooling in pure nitrogen;

e) gradually heating the sintered molded shape in an inert gas; and, f) hydrostatically pressing the sintered molded shape at temperatures of between 250° and 1300° C. and at pressures of between 3,000 kg/cm$^2$ and 10,000 kg/cm$^2$ for three hours.

4. The method of claim 3 wherein:

said step of thoroughly mixing and crushing magnetic material comprising iron oxide ($Fe_2O_3$), nickel oxide (Nio) and zinc oxide (ZnO) comprises mixing 49.7 mol % of $Fe_2O_3$, 1.77 mol % of NiO, and 32.6 mol % of ZnO.

5. The method of claim 3 wherein:

said step of thoroughly mixing and crushing magnetic material comprising iron oxide ($Fe_2O_3$), nickel oxide (Nio) and zinc oxide (ZnO) includes the step of pre-sintering the magnetic material at 900° C. in atmosphere before crushing.

6. The method of claim 3 wherein:

said step of thoroughly mixing and crushing magnetic material comprising iron oxide ($Fe_2O_3$), nickel oxide (Nio) and zinc oxide (ZnO) includes the step of adding 1% by weight of polyvinyl alcohol (PVA) as a binder to the ferrite particles for granulation.

7. The method of claim 3 wherein:

said step of sintering the molded shape by heating in an atmosphere of nitrogen containing oxygen and then cooling in pure nitrogen comprises heating at 1125° C. for about five hours.

8. The method of claim 3 wherein:

said step of gradually heating the sintered molded shape in an inert gas comprises heating at the rate of about 100° C./hour.

9. The method of claim 3 wherein:

said step of mixing the granulated ferrite particles with 1% by weight of metallic particles comprises mixing the granulated ferrite particles with 1% by weight of copper (Cu).

10. The method of claim 3 wherein:

said step of mixing the granulated ferrite particles with 1% by weight of metallic particles comprises mixing the granulated ferrite particles with 1% by weight of iridium (Ir).

11. A ferrite molding material having increased ductility and low hydroscopicity comprising:

a) a mixture of ferrite particles composed of sintered magnetic materials including iron oxide; and, b) copper (Cu) disposed in gaps among said ferrite particles.

12. A ferrite molding material having increased ductility and low hydroscopicity comprising:

a) a mixture of ferrite particles composed of sintered magnetic materials including iron oxide; and b) iridium (Ir) disposed in gaps among said ferrite particles.

13. A method of manufacturing a ferrite molding having increased ductility and low hydroscopicity comprising the steps of:

a) mixing granulated ferrite particles with metallic particles to form a molding mixture;

b) molding the molding mixture into a desired shape;

c) heating the molded shape of molding mixture to sinter it and produce a ferrite molding comprising a mixture of ferrite particles and a metal; and, d) hydrostatically pressing the ferrite molding at a pressure ranging between 3,000 kg/cm$^2$ and 10,000 kg/cm$^2$ to produce a ferrite molding comprising a mixture of ferrite particles having a metal disposed in gaps among the ferrite particles.

14. A method of manufacturing a ferrite molding having increased ductility and low hydroscopicity comprising the steps of:

a) mixing granulated ferrite particles with 1% by weight of metallic particles to form a molding mixture;

b) molding the molding mixture into a desired shape;

c) heating the molded shape of molding mixture to sinter it and produce a ferrite molding comprising a mixture of ferrite particles and a metal.

15. The method of claim 14 wherein:

said step of mixing granulated ferrite particles with 1% by weight of metallic particles comprises mixing granulated ferrite particles with 1% by weight of copper (Cu).

16. The method of claim 14 wherein:

said step of mixing granulated ferrite particles with 1% by weight of metallic particles comprises mixing granulated ferrite particles with 1% by weight of iridium (Ir).

* * * * *